US010955775B2

(12) United States Patent
Kawai et al.

(10) Patent No.: US 10,955,775 B2
(45) Date of Patent: Mar. 23, 2021

(54) FIXING APPARATUS WITH A TEMPERATURE SENSOR DETECTING A TEMPERATURE OF A SURFACE OF A FIXING BELT

(71) Applicant: CANON KABUSHIKI KAISHA, Tokyo (JP)

(72) Inventors: Hiroki Kawai, Abiko (JP); Mitsuru Hasegawa, Tsukubamirai (JP); Asuna Fukamachi, Kashiwa (JP); Akiyoshi Shinagawa, Kasukabe (JP); Suguru Takeuchi, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,463

(22) Filed: Jul. 30, 2019

(65) Prior Publication Data

US 2020/0041940 A1 Feb. 6, 2020

(30) Foreign Application Priority Data

Jul. 31, 2018 (JP) ..... JP2018-143834

(51) Int. Cl.
*G03G 15/20* (2006.01)

(52) U.S. Cl.
CPC ..... *G03G 15/2039* (2013.01); *G03G 15/2017* (2013.01); *G03G 15/2053* (2013.01); *G03G 2215/2025* (2013.01)

(58) Field of Classification Search
CPC ..... G03G 15/2017; G03G 15/2039; G03G 15/2053; G03G 2215/2025
See application file for complete search history.

(56) References Cited

U.S. PATENT DOCUMENTS 8,195,057 B2 6/2012 Hachisuka
8,818,254 B2 8/2014 Arimoto et al.
(Continued)

FOREIGN PATENT DOCUMENTS

JP 2009116133 A * 5/2009
JP 2010-048987 A 3/2010
(Continued)

OTHER PUBLICATIONS

Machine translation of JP 2009-116133 A (with publication date of May 2009) printed on Feb. 18, 2020.*
(Continued)

*Primary Examiner* — Sophia S Chen
(74) *Attorney, Agent, or Firm* — Venable LLP

(57) ABSTRACT

An image fixing device includes a rotatable fixing belt, a pressing roller, a nip forming member, a heating roller, a cooling fan, a temperature sensor, and a controller. The nip forming member contacts an inner surface of the fixing belt to sandwich the fixing belt between the pressing roller to form a nip. The heating roller stretches the fixing belt. The cooling fan cools the fixing belt and is opposite to the belt at a position downstream of the heating roller and upstream of the nip forming member in the rotational movement direction of the fixing belt. The temperature sensor detects a temperature of the fixing belt and is provided at a position downstream of the cooling fan and upstream of the nip. The controller controls the power supplied to the heater on the basis of an output of the temperature sensor.

8 Claims, 13 Drawing Sheets

(56) References Cited

U.S. PATENT DOCUMENTS

| | | | | |
|---|---|---|---|---|
| 8,917,999 | B2 | 12/2014 | Takada et al. | |
| 8,918,003 | B2 | 12/2014 | Kawai et al. | |
| 8,929,762 | B2 | 1/2015 | Shinagawa et al. | |
| 8,983,325 | B2 | 3/2015 | Takeuchi | |
| 9,207,593 | B2 | 12/2015 | Fukamachi | |
| 9,235,168 | B2 | 1/2016 | Kawai | |
| 9,372,450 | B2 | 6/2016 | Kitagawa et al. | |
| 9,459,566 | B2 | 10/2016 | Kitagawa et al. | |
| 10,133,219 | B2 | 11/2018 | Kawai | |
| 10,241,433 | B2 | 3/2019 | Tanaka et al. | |
| 2010/0046973 | A1* | 2/2010 | Hachisuka | G03G 15/2039 399/69 |
| 2011/0280607 | A1* | 11/2011 | Tanaka | G03G 15/2014 399/67 |
| 2013/0084088 | A1* | 4/2013 | Sakai | G03G 15/2039 399/45 |
| 2013/0142532 | A1 | 6/2013 | Kitagawa et al. | |
| 2014/0205330 | A1* | 7/2014 | Abe | G03G 15/2017 399/307 |
| 2015/0037055 | A1 | 2/2015 | Kitagawa et al. | |
| 2015/0063846 | A1* | 3/2015 | Fukai | G03G 15/2032 399/45 |
| 2017/0090362 | A1* | 3/2017 | Katada | G03G 15/2039 |
| 2017/0168432 | A1* | 6/2017 | Kikushima | G03G 15/2017 |
| 2019/0369533 | A1* | 12/2019 | Aso | G03G 15/2039 |
| 2019/0377287 | A1 | 12/2019 | Hasegawa et al. | |

FOREIGN PATENT DOCUMENTS

| | | | |
|---|---|---|---|
| JP | 2011123293 | A * | 6/2011 |
| JP | 2014-032374 | A | 2/2014 |
| JP | 2014-203058 | A | 10/2014 |

OTHER PUBLICATIONS

Machine translation of JP 2011-123293 A (with publication date of Jun. 2011) printed on Feb. 18, 2020.*

* cited by examiner

FIXING APPARATUS WITH A TEMPERATURE SENSOR DETECTING A TEMPERATURE OF A SURFACE OF A FIXING BELT

CROSS-REFERENCE TO RELATED APPLICATION

This application claims the benefit of Japanese Patent Application No. 2018-143834 filed on Jul. 31, 2018, which is hereby incorporated by reference herein in its entirety.

FIELD OF THE INVENTION AND RELATED ART

The present invention relates to a fixing apparatus usable by an image forming apparatus, such as a copying machine, a printing machine, a facsimileing machine, etc., that uses an electrophotographic image forming method and is capable of forming an image on recording medium.

In recent years, it has been desired to increase the image formication speed of an image forming apparatus, in particular, an image forming apparatus of the so-called on-demand type, and to enable an image forming apparatus to deal with various recording media. Increasing an image forming apparatus in speed sometimes causes the following issue, particularly, in a case when recording medium having relatively large in basis weight (cardstock, for example) is used as recording medium. That is, in a case when recording medium having a large basis weight is used as recording medium, the fixing nip of a fixing apparatus substantially reduces in temperature, as the recording medium passes through the fixing nip, making it likely for fixing failure to occur. Therefore, it is desired to ensure that the fixing nip of a fixing apparatus can supply each sheet of recording medium with a sufficient amount of heat for satisfactorily fixing a toner image on each sheet, even when an image formation job requires a substantial number of sheets of recording medium to be conveyed in succession.

Thus, there have been proposed various technologies for increasing the heating performance of a fixing apparatus to improve the productivity of the fixing apparatus, particularly, when thick paper is used as recording medium. One of such technology is disclosed in Japanese Laid-open Patent Application No. 2014-203058. According to this document, the fixing apparatus is provided with a fixing roller, which is large in thermal capacity, and in which a heat source is placed. There is also proposed an image forming apparatus structured so that an external heating member such as an external heat roller is placed in contact with the fixing roller to externally heat the fixing roller. Moreover, there is disclosed a fixing apparatus which is provided with a cooling fan, an external heating roller, a temperature detecting means, listing from the downstream end of the fixing nip in terms of the rotational direction of the fixing roller.

In Japanese Laid-open Patent Application No. 2014-203058, the image heating apparatus is structured in consideration of the productivity in a job which comprises two or more sections which are different in recording medium. For example, when recording medium is changed from thin paper to thick paper (cardstock, for example), a cooling fan is started while recording medium is thin paper to store a sufficient amount of heat in the fixing roller, which is large in thermal capacity, so that the fixing apparatus is increased in the amount by which it is supplied with heat.

However, according to Japanese Laid-open Patent Application 2014-203058, a heater is disposed within a hollow of the fixing roller to make the fixing roller store heat, so that the fixing nip is formed by the fixing roller which is holding a substantial amount of heat. Thus, the temperature of the fixing roller is significantly affected by the amount of heat stored in the fixing roller. Therefore, in the case of a mixed recording medium job, that is, a job in which recording medium is changed from one type to the other which is different in basis weight, it takes substantial length of time for the temperature of the fixing roller to increase or decrease to a proper level for the second recording medium. In particular, in a case when a mixed recording medium job in which recording medium is switched from thick paper to thin paper, it is necessary to cool the fixing roller which is holding a sufficient amount of heat for thick paper. Therefore, it is unlikely for the temperature of the fixing roller to come down to a level which is suitable for thin paper in a short length of time. That is, the fixing apparatus disclosed in Japanese Laid-open Patent Application No. 2,014-203,058 has an issue in terms of productivity, and it is therefore desired to be improved further.

SUMMARY OF THE INVENTION

The primary object of the present invention is to provide a fixing apparatus which is capable of remaining highly productive even when an image forming apparatus to which it belongs is used for a mixed recording medium job.

According to one aspect, the present invention provides a fixing device for fixing a toner image on a recording material. The fixing device includes a rotatable fixing belt, a pressing roller, a nip forming member, a heating roller, a cooling fan, a temperature detecting member, and a controller. The pressing roller cooperates with the fixing belt to form a nip configured to nip and feed the recording material. The nip forming member contacts an inner surface of the fixing belt and to sandwich the fixing belt between the pressing roller and itself to form the nip. The heating roller includes a heater therein and stretches the fixing belt. The cooling fan is configured to cool the fixing belt and is opposite to a surface of the belt at a position downstream of the heating roller and upstream of the nip forming member in the rotational movement direction of the fixing belt. The temperature detecting member is configured to detect a temperature of the fixing belt and is provided at the position downstream of the cooling fan and upstream of the nip in the rotational movement direction. The controller is configured to control an electrical power supply to the heater on the basis of an output of the temperature detecting member.

Further features of the present invention will become apparent from the following description of exemplary embodiments with reference to the attached drawings.

BRIEF DESCRIPTION OF THE DRAWINGS

FIG. 10 is a graph which shows the difference in the fixing belt cooling performance of the fixing apparatus having two fixing belt cooling fans, between only one fan is on, and when both fans are on.

DESCRIPTION OF THE EMBODIMENTS

Hereafter, the present invention is described with reference to a few preferred embodiments of the present invention and appended drawings.

Embodiment 1

(Image Forming Apparatus)

Figure 1:
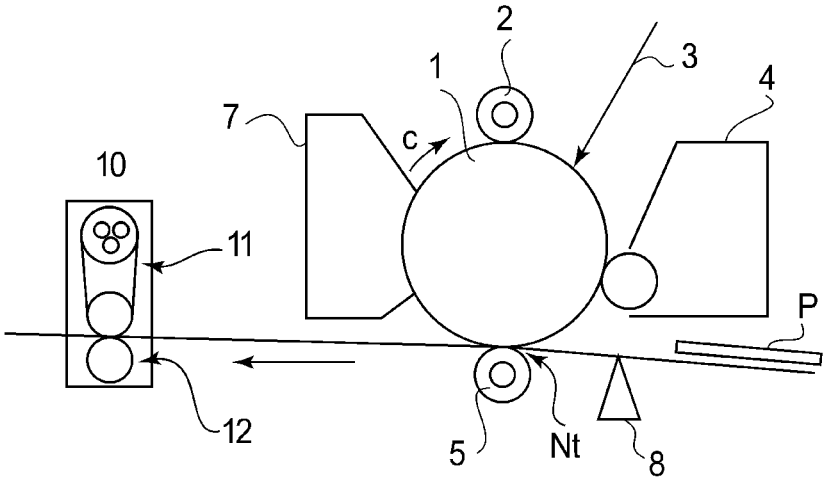
FIG. 1 is a schematic sectional view of an image forming apparatus having an image heating apparatus which is in accordance with the present invention.

FIG. 1 is a schematic sectional view of the image forming apparatus having an image heating apparatus (fixing apparatus) in the first embodiment of the present invention. FIG. 1 shows the general structure of the apparatus. Referring to FIG. 1, the image forming apparatus is provided with an electrophotographic photosensitive member 1 (which hereafter will be referred to as photosensitive drum), which is an image bearing member in the form of a drum. The photosensitive drum 1 is made up of a cylindrical substrate formed of aluminum, nickel, or the like, and a layer of a photosensitive substance, such as amorphous selenium and amorphous silicon, formed on the peripheral surface of the cylindrical substrate. The photosensitive drum 1 is rotationally driven in the direction indicated by arrow c, while being uniformly charged across its peripheral surface by a charge roller 2 as a charging apparatus.

Next, the charged surface of the photosensitive drum 1 is exposed to (scanned by) a beam 3 of laser light emitted by an exposing apparatus, while being modulated according to the information of the image to be formed, that is, turned on or off in accordance with the information of the image to be formed. Consequently, an electrostatic latent image is effected on the peripheral surface of the photosensitive drum 1. This electrostatic latent image is developed by a developing apparatus 4, into a visible image. As for developing methods, there are a jumping developing method, a two-component developing method, an FEED developing method, and the like. It is not uncommon that image exposure and reversal development are used in combination.

As a sheet P of recording medium is fed into the main assembly of the image forming apparatus, its leading edge is detected by a top sensor 8 which is disposed on the upstream side of the transfer nip Nt, in terms of the recording medium conveyance direction, so that it is conveyed to the transfer nip Nt in synchronism with the arrival of the visible toner image on the photosensitive drum 1 at the secondary transfer nip Nt. In the secondary transfer nip Nt, the toner image on the photosensitive drum 1 is transferred from the photosensitive drum 1 by a transfer roller 5 as a transferring apparatus, onto the sheet P of recording medium, as the sheet P is conveyed through the secondary transfer nip Nt. During this transferring process, the sheet P is conveyed through the secondary transfer nip Nt while remaining pinched by the photosensitive drum 1 and transfer roller 5, and therefore, the sheet P is subjected to a preset amount of pressure. After the transfer of the toner image onto the sheet P, the sheet P is conveyed to the fixing apparatus 10, by which the toner image T (see FIG. 2) is fixed to the sheet P, that is, turned into a permanent image.

Meanwhile, the transfer residual toner, that is, the toner remaining on the photosensitive drum 1 after the transfer of the toner image from the photosensitive drum 1, is removed from the peripheral surface of the photosensitive drum 1 by a cleaning apparatus 7.

(Image Heating Apparatus)

Figure 2:
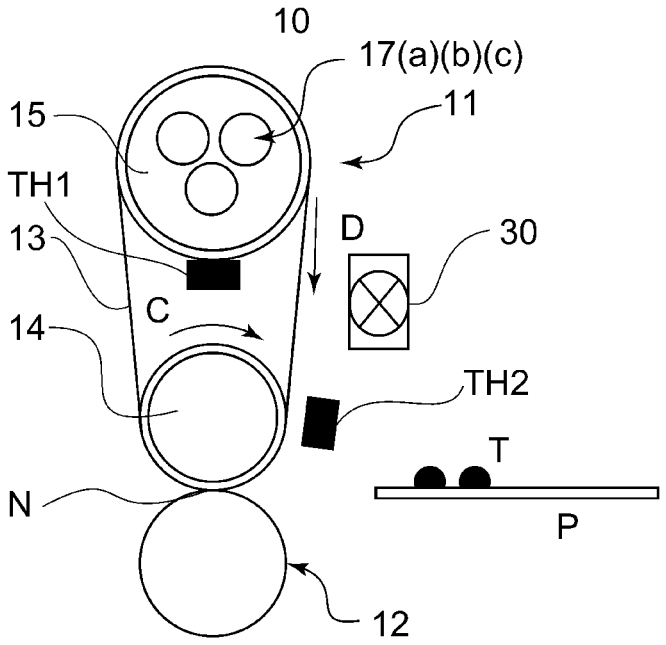
FIG. 2 is a schematic sectional view of the fixing apparatus in the first embodiment of the present invention.

Next, the fixing apparatus 10, as an image heating apparatus, in this embodiment is described. FIG. 2 is a schematic sectional view of the fixing apparatus 10 in this embodiment, at a plane which is parallel to the recording medium conveyance direction. FIG. 2 shows the general structure of the fixing apparatus 10. In this specification, "lengthwise direction" means a direction that is perpendicular to the recording medium conveyance direction and also the thickness direction of a sheet of recording medium. The lengthwise direction is equivalent to the widthwise direction of the sheet P.

The fixing apparatus 10 is provided with a fixing belt module 11, as the first rotational member, and a pressure roller 12, as the second rotational member. The fixing belt module 11 comprises a fixing roller 14. The pressure roller 12 is disposed so that it remains pressed upon the fixing belt module 11. The fixing roller 14 and pressure roller 12 coordinate with each other to form a nip N, through which a sheet P of recording medium is conveyed while remaining pinched between the fixing belt 13 and pressure roller 12.

The fixing belt module 11 includes a fixing belt 13, the fixing roller 14, and the heat roller 15. The fixing belt 13 is an endless belt, for example. The fixing roller 14 is disposed in contact with the inward surface of the fixing belt 13 and rotationally drives the fixing belt 13 while providing the fixing belt 13 with a preset amount of tension. The heat roller 15, as the third rotational member, is disposed in contact with the inward surface of the fixing belt 13 while providing the fixing belt 13 with the preset amount of tension. The fixing belt module 11 and pressure roller 12 are kept pressed upon each other, forming thereby aforementioned nip N.

The cooling fan 30 is on the upstream side of the nip N in terms of the rotational direction of the fixing belt 13. It cools the surface of the fixing belt 13, in the area between the heat roller 15 and nip N, by blowing air at the surface of the fixing belt 13. Further, the fixing apparatus 10 is provided with a temperature detecting portion for detecting the temperature of the fixing belt 13. The temperature detecting portion is positioned as follows.

A thermistor TH1 is placed, as the first temperature detecting member, in contact with the heat roller 15 to detect the temperature of the heat roller 15. Further, a thermopile TH2 is disposed as the second temperature detecting member, in the adjacencies of the fixing belt 13 to detect the temperature of the fixing belt 13, with no contact between the thermopile TH2 and fixing belt 13. The thermopile TH2 is of the so-called no-contact type. It detects the surface temperature of the fixing belt 13 in the area between the area in which the belt 13 is cooled by the cooling fan 30 and the nip N. That is, the cooling fan 30 and thermopile TH2 are disposed so that, listing from the upstream side in terms of the rotational direction of the fixing belt 13, there are an area in which the fixing belt 13 is heated by the heat roller 15, an area in which the fixing belt 13 is cooled by the cooling fan 30, and an area in which the temperature of the fixing belt 13 is detected by the thermopile TH2.

(Fixing Roller)

The fixing roller 14 is a hard roller. The fixing roller 14 is made up of a cylindrical aluminum core (metallic core), which is 60 mm in external diameter, 360 mm in length, and 10 mm in thickness, for example, and a 200 μm thick layer of fluorinated resin, as a protective layer, coated on the peripheral surface of the metallic core to prevent the peripheral surface of the metallic core from being frictionally worn. However, this embodiment is not intended to limit the present invention in scope in terms of the structure of the fixing roller 14. That is, the present invention is compatible with any fixing roller as long as it is structured so that it is hardly deformed by the pressure applied thereto by the pressure roller 12 to form the nip N between itself and pressure roller 12.

Further, in this embodiment, the fixing apparatus 10 is structured so that the fixing roller 14 is not provided with a heat source. However, the fixing apparatus 10 may be structured so that the fixing roller 14 is provided with a heat source. The fixing roller 14 is a rotational member which receives driving force from an unshown driving motor. As the fixing roller 14 receives the driving force, the fixing roller 14 rotates in the direction indicated by arrow C at a peripheral velocity of 440 mm/s, for example.

(Fixing Belt)

The fixing belt 13 is a flexible endless belt, which is 500 mm in length and 340 mm in width, for example. The fixing belt 13 is multi-layered having, in this embodiment, a base layer, which is 70 μm in thickness and formed of polyimide resin, and an elastic layer, which is layered upon the outward surface (peripheral surface side) of the base layer. The elastic layer is formed of silicone rubber and is 200 μm in thickness. Further, the fixing belt 13 is provided with a release layer placed in a manner to cover the elastic layer. The release layer is a piece of 30 μm thick tube formed of copolymer of tetrafluoroethylene and perfluoroalkylvinylether (PFA).

The elastic layer is provided to enable the surface portion of the fixing belt 13 to conform to the microscopic peaks and valleys of the toner image T on a sheet P of recording medium in order to improve an electrophotographic image forming apparatus in the quality of a color image. By the way, regarding the structure of the fixing belt 13, the material, thickness, hardness, and the like properties for the fixing belt 13, may be selected according to the objective of belt usage and the conditions under which the belt 13 is used, and the like that are required of the fixing belt 13. The fixing belt 13 is rotationally moved by the fixing roller 14 in the direction indicated by arrow D.

(Heat Roller)

The heat roller 15 is a cylindrical roller formed of aluminum. The heat roller 15 is 100 mm in external diameter, 2 mm in thickness, and 360 mm in length, for example. Halogen heaters 17*a*, 17*b*, 17*c* are disposed the hollow of the heat roller 15, as heat sources. In this embodiment the halogen heaters 17*a*, 17*b*, 17*c* are 1200 W in rated power. The surface temperature of the heat roller 15 is controlled by a combination of the temperature sensor TH1, and a control portion 100, which will be described later. Therefore, the heat roller 15 has both the function of keeping the fixing belt 13 suspended and tensioned and the function of heating the fixing belt 13 from the inward side of the fixing belt 13 in terms of the loop which the fixing belt 13 forms.

Further, the fixing apparatus 10 is provided with a pair of elastic members (unshown), which are positioned at the lengthwise ends of the heat roller 15, one for one. Therefore, the heat roller 15 has the function of continuously providing the fixing belt 13 with a preset amount (15 kgf, for example) of tension. Moreover, the heat roller 15 is provided with a mechanism for preventing the fixing belt 13 from deviating in position in terms of its widthwise direction. That is, the heat roller 15 functions also as a steering roller for preventing the fixing belt 13 from deviating in position.

(Pressure Roller)

Next, the pressure roller 12 is a so-called soft roller. The pressure roller 12 is a multilayer roller made up of a cylindrical substrate, an elastic layer, and a release layer. The substrate is formed of aluminum. and 360 mm in length. The elastic layer is placed on the peripheral surface of the substrate. The elastic layer is 10 mm in thickness. The release layer is a piece of PFA tube. The release layer is placed on the outward surface of the elastic layer and is 100 μm in thickness.

The fixing apparatus 10 is structured so that the pressure roller 12 is pressed upon the fixing belt module 11. Thus, as the fixing roller 14 of the fixing belt module 11 rotates in the direction indicated by arrow C, the pressure roller 12 is rotated by the movement of the fixing belt 13. The speed of the pressure roller 12 is 440 mm/s, which is the same as the peripheral velocity of the fixing roller 14. In this embodiment, the pressure roller 12 is not provided with a heat source. The pressure roller 12 may, however, be provided with a heat source.

(Temperature Detecting Means)

The temperature sensor TH1 is a temperature detection element such as a thermistor, for example. The temperature sensor TH1 is disposed in contact with the heat roller 15. This temperature sensor TH1 detects the surface temperature of the heat roller 15 in the area which corresponds to the path of the widest sheet of recording medium conveyable through the nip N. The temperature detected by the temperature sensor TH1 is fed back to the control portion 100. The control portion 100 controls the electrical power that is to be inputted into the halogen heaters 17*a*, 17*b* and 17*c* in such a manner that the temperature, which is detected by the temperature sensor TH1 and is inputted into the control portion 100, remains at a target level.

The fixing apparatus 10 is provided with three temperature sensors TH1 (TH1(*a*), TH1(*b*) and TH1(*c*)), which are distributed in the lengthwise direction of the heat roller 15. They detect the temperature of the heat roller 15, in the area in the recording medium sheet path, and the area out of the recording medium sheet path. The detected temperatures (information) are sent to the control portion 100.

As for the temperature sensor TH2, the fixing apparatus 10 is provided with three temperature sensors TH2 (TH2(*a*), TH2(*b*) and TH2(*c*)), which are distributed in the lengthwise direction of the heat roller 15 like the temperature sensor TH1, in a manner to face the outward surface of the fixing belt 13. The temperature sensors TH2 detect the temperature of the fixing belt 13 in the area within the recording medium sheet path and the area outside the recording medium sheet path and send detected temperature to the control portion 100. By the way, the fixing apparatus 10 may be structured so that the temperature sensors TH2 are disposed on the inward side of the fixing belt loop.

In this embodiment, the thermistor for detecting the temperature of the center portion of the heat roller 15 in terms of the lengthwise direction, and the thermopile for detecting the temperature of the center portion of the fixing belt 13 in terms of the lengthwise direction, are used for temperature control. Hereafter, they may be referred to as temperature sensors TH1 and TH2, respectively.

(Cooling Fan)

Figure 3:
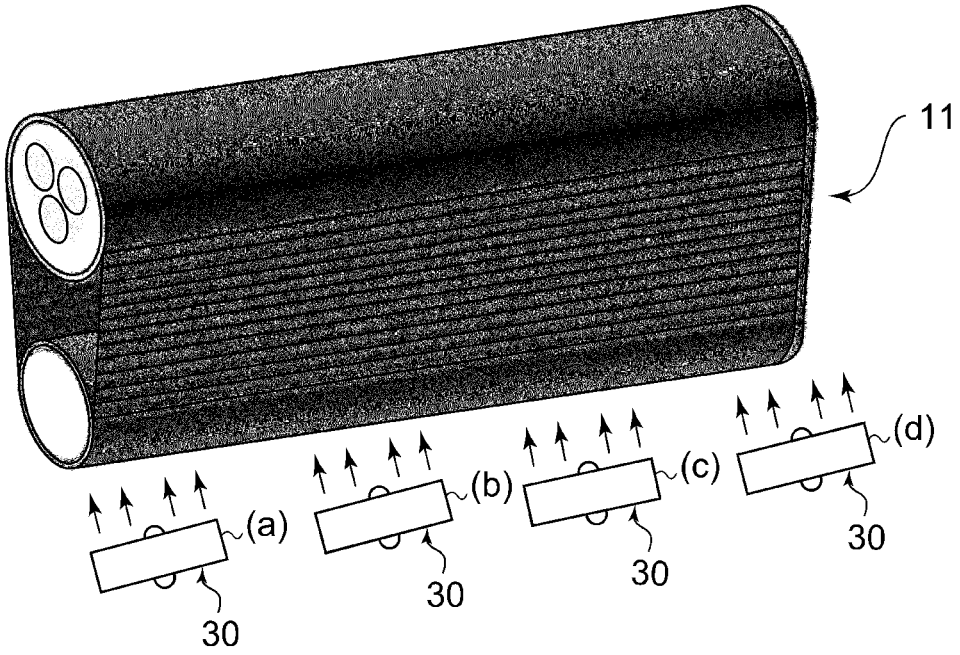
FIG. 3 is a schematic perspective view of the fixing apparatus in the first embodiment.

Next, referring to FIG. 3, the operation of the fixing apparatus 10 in this embodiment is described when the cooling fan 30 for the fixing belt 13 is used. The cooling fan 30 is an apparatus which blows air toward the fixing belt 13 to cool the fixing belt 13. As the cooling fan 30, a sirocco fan, a cross-flow ran, an axial-flow fan, or the like is used. The cooling fan 30 in this embodiment is an axial-flow fan, which has a maximum rotation speed of 6000 rpm. The rotation speed of the cooling fan 30 is controlled by voltage adjustment. The rotation speed of the cooling fan 30 may be greater or less in the maximum number of revolution than 6000 rpm.

The fixing apparatus 10 is provided with four cooling fans 30 (30(*a*), 30(*b*), 30(*c*) and 30(*d*)), which are distributed in the widthwise direction of the fixing belt 13, being therefore capable of cooling the fixing belt 13 across even the entire area of the path of the widest sheet of recording medium. By the way, the fixing apparatus 10 can be structured so that each fan 30 is independently driven from the others. In this embodiment, the fixing apparatus 10 is structured so that each fan 30 cannot be independently driven from the others. Therefore, the combination of the four cooling fans 30 is referred to as the cooling fan 30.

The information regarding the temperatures detected by the temperature sensors TH1 and TH2 and the electrical power to be inputted into the cooling fan 30 are controlled so that the temperature detected by sensors TH1 and TH2 remain at preset target levels.

(Control Portion and Control Panel)

Figure 4:
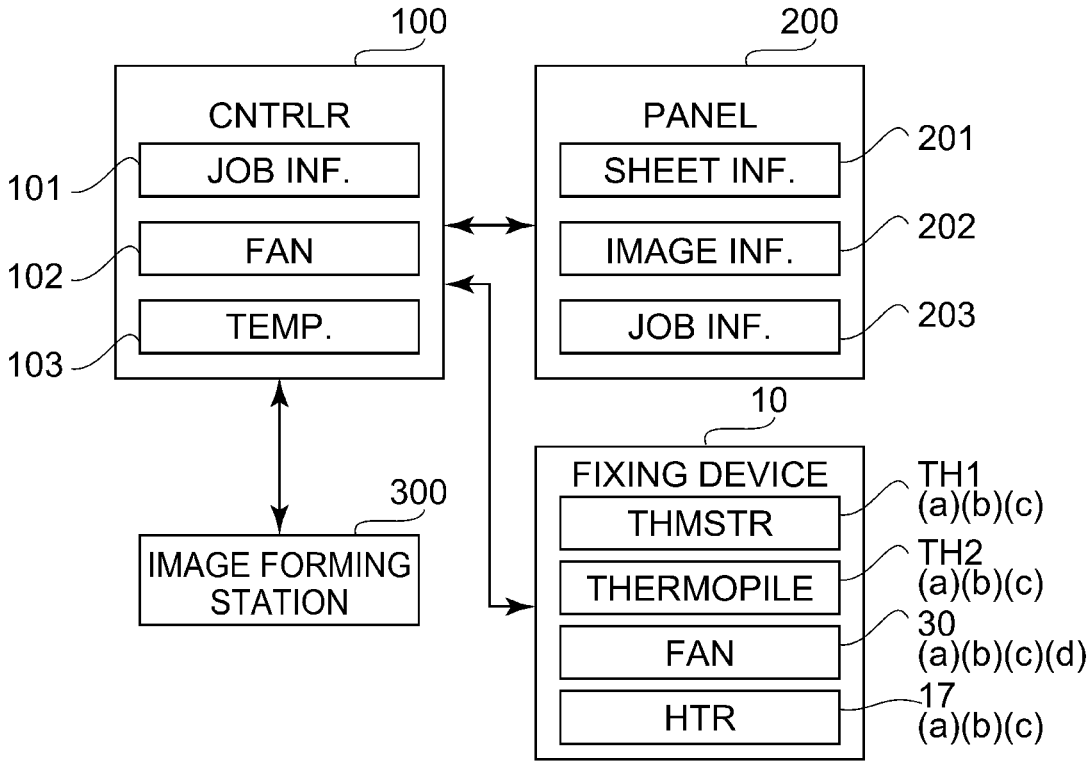
FIG. 4 is a block diagram of the control portion of the image forming apparatus to which the fixing apparatus belongs in the first embodiment.

Referring to FIG. 4, the image forming apparatus is provided with the control portion 100, as a controlling means; a control panel 200, which is in connection to the control portion 100; the image forming portion 300, described above; and fixing apparatus 10, described above as well. The control panel 200 functions as an interface for a user to access the apparatus. The control portion 100 oversees and controls the operation of each portions of the image forming apparatus. Further, it integrally controls the command system for various units to coordinate various command systems.

The operating portion 200 has a recording medium information obtaining means 201, an image information obtaining means 202, and a job information obtaining means 203. The recording medium information obtaining means 201 obtains recording medium information such as the basis weight, surface properties, and the like, of the recording medium inputted by user, as print job information.

The image information obtaining means 202 obtains the basic information, such as image density, regarding the image to be formed. The job information obtaining means 203 obtains job information, such as print count; whether the job is to be carried out in single- or double-sided mode, whether the job requires only one, or two, or more types; of recording medium, that is, whether the job requires recording medium to be changed with no interruption, or not.

As the control portion 100 receives a mixed recording medium job, that is, such a job that has two or more (two in this embodiment) sections (preceding and following sections), that is, a section which uses recording medium which is greater in basis weight than a preset value, and another section which is greater in basis weight than the first section, and is to be continuously carried out after the first section, the control portion 100 makes the image forming apparatus continuously carry out the first and second sections in the first and second modes, respectively. In a case when a job comprises a section that uses thin paper as recording medium and the following section uses thick paper as recording medium, a sheet P of recording medium which is no more in basis weight than the preset value (120 g/m$^2$, for example) is referred to as the first recording medium, whereas a sheet of recording medium (thick paper) which is no less than 120 g/m$^2$ is referred to as the second recording medium.

The above-mentioned first mode is such a mode that while the image forming apparatus is carrying out the first section of the mixed medium job, the control portion 100 controls the fixing apparatus 10 so that the temperature detected by the temperature sensor TH2 remains at a target level under a preset condition. The second mode is such a mode that the control portion 100 changes the control condition from the abovementioned one, maintaining the target level while the image forming apparatus is carrying out the first section.

That is, while the recording medium is changed from the thin paper to thick paper, the control portion 100 makes the image forming apparatus begin operating in the second mode, in which the halogen heaters 17*a*, 17*b* and 17*c* are increased in the amount of heat production, and also, the cooling fan 30 is made to begin operating.

Further, as the first section of the mixed recording medium job is completed in the second mode, the control portion 100 makes the cooling fan 30 stop operating. Moreover, the control portion 100 controls the fixing apparatus 10 so that as the temperature detected by the temperature sensor TH2 reaches the target level for the second section of the mixed medium job, the image forming apparatus starts the second section.

Further, as the control portion 100 receives a mixed recording medium job which comprises the first section which uses sheets P of recording medium which are greater in basis weight than a preset value, and the second section which uses sheets P of recording medium which are no more in basis weight than the preset value, are to be continuously carried out, the control portion 100 makes the image forming apparatus operate as follows, after the completion of the first section in the second mode. That is, the control portion 100 stops the electrical power supply to the halogen heaters 17*a*, 17*b* and 17*c*, and makes the cooling fan 30 begin operating. Further, as the temperature detected by the temperature sensor TH2 reaches the target level for the second section of the mixed medium job, the control portion 100 makes the image forming apparatus start the second section.

By the way, it is not mandatory that the print job information is to be inputted through the control panel 200. That is, the information may be inputted into the image forming apparatus (control portion 100) from an external device such as a PC. The information inputted into the image forming apparatus is temporarily stored in a job information holding means 101, with which the control portion 100 is provided. Then, it is used as control parameter for each operation while the job is carried out.

(Medium-Based Setting of Target Temperature)

In this embodiment, when sheets P of recording medium (thin paper), which are no more in basis weight than a preset value, are used for a given job, the target temperature for the fixing belt 13 is 150° C., and the target temperature for the heat roller 15 is 170° C. On the other hand, when sheets P of recording medium (cardstock), which are no less in basis weight than the preset value, are used for a given job, the target temperature for the fixing belt 13 is 170° C., and the target temperature for the heat roller 15 is 190° C.

Here, the above-mentioned preset value for basis weight is as follows. That is, recording medium which is no less in basis weight than 120 g/m$^2$ is referred to as thick paper, whereas recording medium which is no more in basis weight than 120 g/m$^2$ is referred to as thin paper. Further, in order to ensure that toner images T are properly fixed to recording medium, and also, that each sheet P of recording medium is satisfactorily conveyed (without wrinkling, without becoming wavy, satisfactorily separating from fixing belt 13, for example), the greater in thermal capacity recording medium is, the greater the amount by which heat is supplied to the fixing belt 13. If the amount by which heat is supplied to the fixing belt 13 is excessive when thin paper is used as recording medium, the sheet P is likely to wrinkle, become wavy, and/or suffer from the like undesirable effects. Therefore, when thin paper is used as recording medium, the target temperature is set relatively low. On the other hand, if the amount by which the fixing belt 13 is supplied with heat is insufficient when thick paper is used as recording medium, toner particles are likely to offset, and/or the image forming apparatus 1 is likely to output images which are insufficient in glossiness. Therefore, the target temperature is set relatively high.

(Control to be Executed when Recording Medium is Changed from Thin Paper to Thick Paper)

Figure 5:
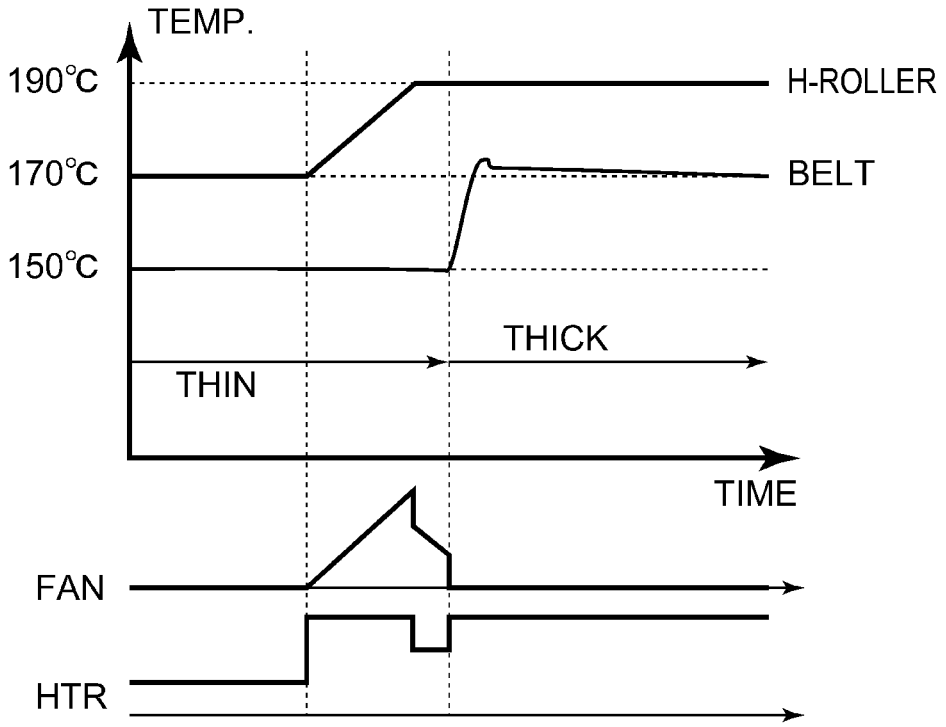
FIG. 5 is a graph which shows the relationship among the changes which occur to the temperature of the heat roller, temperature of the fixing belt, timing with which a cooling fan begins to be operated, and amount of heater output, when an image forming apparatus in the first embodiment is operated.

Referring to FIG. 5, in the case of a mixed medium job in which sheets of thick paper are conveyed after the conveyance of a substantial number of sheets of thin paper, a certain length of time is necessary to increase the temperature of the heat roller 15 from 170° C. to 190° C. That is, the image forming apparatus 1 has to be kept on standby for the certain length of time. In other words, the image forming apparatus reduces in overall productivity.

In this embodiment, therefore, the control portion 100 controls the fixing apparatus 10 in such a manner that the fixing apparatus 10 is put in the second mode. In the second mode the halogen heaters 17*a*, 17*b* and 17*c* are increased in the amount of heat generation and also the cooling fan 30 begins to operate, while the image forming apparatus 1 is carrying out the first section of the mixed recording medium job. That is, the control portion 100 increases the target temperature for the heat roller 15 from 170° C. to 190° C. and makes the cooling fan 30 begin operating to make the surface temperature of the fixing belt 13 remain at 150° C.

Then, the control portion 100 stops the cooling fan 30 with the timing with which the mixed recording medium job is switched in recording medium from thin paper to thick paper. By this point in time, the temperature of the heat roller 15 will have changed to the aforementioned one for thick paper. Therefore, the fixing belt 13, which is relatively small in thermal capacity, quickly increases in temperature to 190° C. Therefore, the second portion of the mixed recording medium job can be quickly started.

In this embodiment, the length of time necessary to increase the temperature of the heat roller 15 from 170° C. to 190° C. is roughly 6 seconds. The productivity of the fixing apparatus 10 in this embodiment is expected to be 100 sheets of recording medium, which are equivalent in size to a sheet of recording medium of A4 size, per minute. Therefore, 6 seconds is long enough to convey 10 sheets of recording medium which are equivalent in size to size A4. Therefore, the control for the aforementioned mixed recording medium job in which thin paper is used for the first section of the job, and thick paper is used for the second section, begins to be executed at the first of the last 10 sheets in the first section. Further, in a case when the number of recording medium used in the first section is no more than nine, this control is not executed.

(Control for Switching Recording Medium from Thick Paper to Thin Paper)

Figure 6:
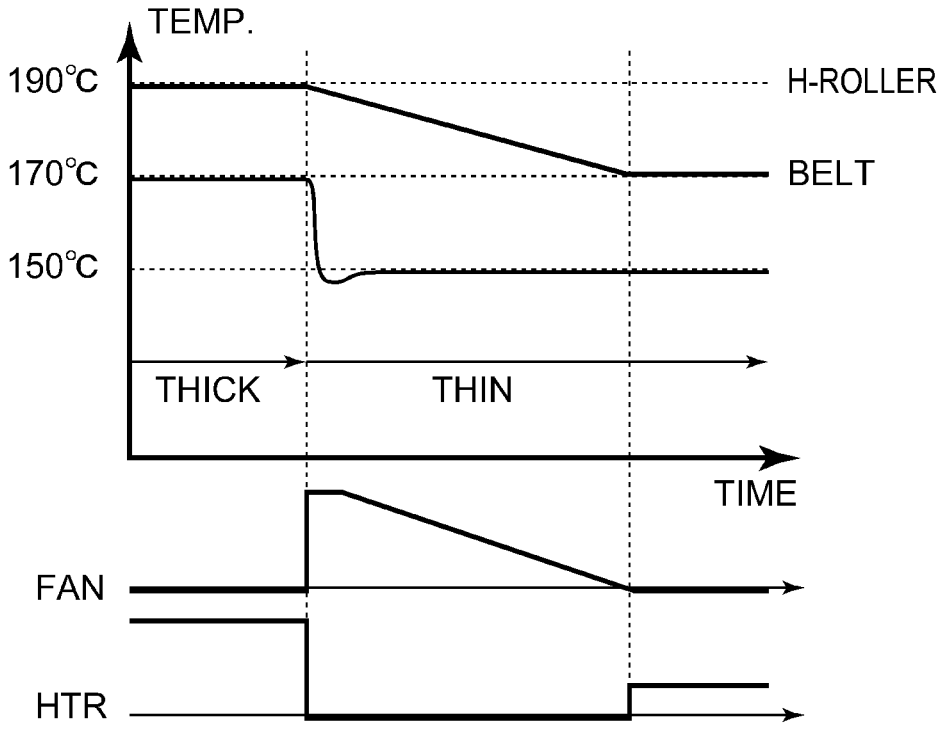
FIG. 6 is a graph which shows the relationship among the changes which occur to the temperature of the heat roller, temperature of the fixing belt, timing with which a cooling fan begins to be operated, and amount of heater output, as recording medium is changed from thick paper to thin paper.

Referring to FIG. 6, in the case of such a job that sheets of thin paper are conveyed through the fixing apparatus 10 after the conveyance of a substantial number of sheets of thick paper, it takes a substantial length of time for the surface temperature of the heat roller 15 to reduce from 190° C. to 170° C. Therefore, the image forming apparatus 1 has to be kept on standby for a relatively long time, thereby reducing overall productively. In particular, while a substantial number of sheets of thick paper are continuously conveyed through the fixing apparatus 10, the halogen heaters 17*a*, 17*b* and 17*c* are almost continuously kept on, in order to prevent the surface temperature of the fixing belt 13 from reducing. Therefore, the heat roller 15, which is relatively large in thermal capacity, increases in its overall temperature. Therefore, the temperature of the fixing belt 13 is unlikely to quickly reduce after the continuous conveyance of a substantial number of sheets of thick paper through the fixing apparatus 10.

In this embodiment, therefore, the electrical power supply to the halogen heaters 17*a*, 17*b* and 17*c* is stopped with the timing with which the last sheet of thick paper in the first section of the fixed medium job comes out of the nip N, and also, the cooling fan 30 is turned on. It takes several tens of seconds to reduce the surface temperature of the heat roller 15 from 190° C. to the target temperature for the thin paper for the second section of the job. However, the fixing belt 13 is small in thermal capacity. Therefore, the surface temperature of the fixing belt 13 is instantly reduced by the cooling fan 30.

During this process, the surface temperature of the fixing belt 13 remains low for a certain length of time until the heat stored in the fixing belt 13 reaches the surface of the fixing belt 13. Since the cooling fan 30 is positioned in the adjacencies of the entrance of the nip N, it is possible to convey the superficially cooled portion of the fixing belt 13 through the nip N while the surface temperature of the fixing belt 13 remains at the low level at which it is before it begins to increase. In terms of the moving direction of the belt, the thermistor TH2 for detecting the temperature of the fixing belt 13 is disposed in the area between the area in which the fixing belt 13 is cooled by the cooling fan 30, and the nip N. Therefore, it is possible to keep the surface temperature of the fixing belt 13 remaining at a level which is suitable for thin paper, in the nip N.

While the surface temperature of the heat roller 15 reduces to 170° C., or the target level for thin paper, the control portion 100 controls the cooling fan 30 until the temperature detected by thermistor TH2 reduces to 150° C. As soon as the temperature of the heat roller 15 reduces to the target level for thin paper, the control portion 100 restarts the electrical supply to the halogen heaters 17*a*, 17*b* and 17*c*, and keeps the temperature of the heat roller 15 at the target level for thin paper.

Therefore, it is possible to quickly start the second section of the mixed recording medium job, after the completion of the first section.

(Control Sequence for Changing Recording Medium from Thin Paper to Thick Paper)

Figure 7:
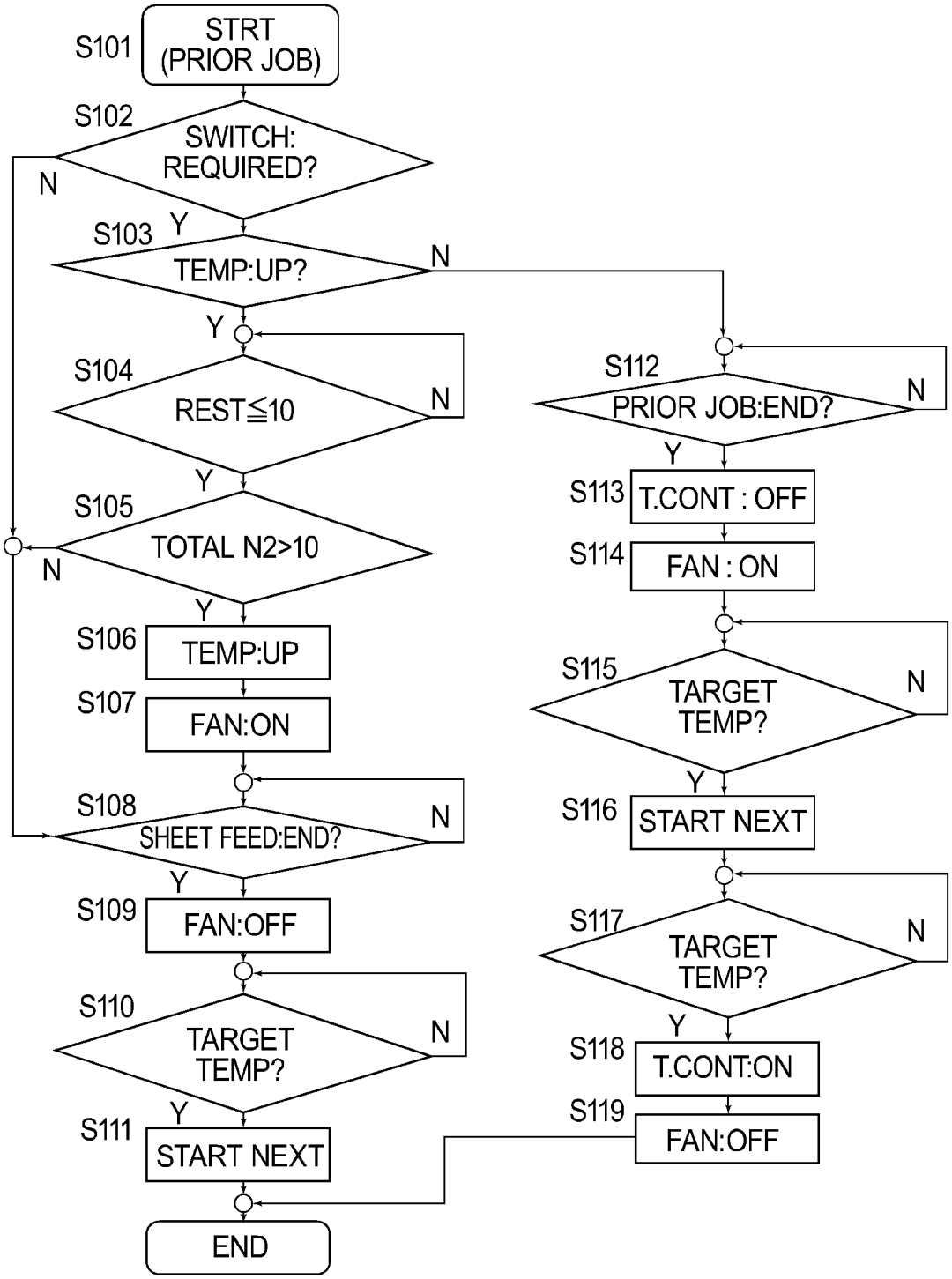
FIG. 7 is a flowchart of the operation of an image forming apparatus equipped with a fixing apparatus in the first embodiment

Next, the control for keeping the temperature of the fixing belt 13 in this embodiment, and the temperature of the heat roller 15 in this embodiment, at their target levels, and the control of the cooling fan 30 in this embodiment, are described. FIG. 7 is a flowchart of the operational sequence for the controls.

Next, referring to FIG. 7 which is a flowchart of the control sequence for the fixing apparatus 10, the actual operational sequence of the fixing apparatus 10 is described with reference to a temperature increase mode in which the image forming apparatus 1 is changed in recording medium from 100 sheets of thin paper (first recording medium), which is 60 g/m$^2$, which is far less than 120 g/m$^2$ in basis weight, to 100 sheets of thick paper (second recording medium) which is 300 g/m$^2$, which is greater than 120 g/m$^2$. Here, thin paper (first recording medium) which is 60 g/m$^2$, which is no greater than 120 g/m$^2$ in basis weight, and thick paper (second recording medium) which is 300 g/m$^2$ which is greater than 120 g/m$^2$, are used.

First, in Step S101, the control portion 100 receives a mixed recording medium job in which a certain number of sheets of thin paper, and a certain number of sheets of thick paper are continuously sent as the recording medium for the first and second sections, respectively, of the job. Then, the control portion 100 receives a command to switch the recording medium while the image forming apparatus 1 is doing the first section of the job. When the recording medium is to be switched is determined by the control portion 100 based on the information regarding recording medium type, image to be formed, and job type, which is stored in the job information holding means 101. Here, the information regarding the second section of the job, in which 100 sheets of thick paper which is 300 g/m$^2$ in basis weight is received by the control portion 100, with the timing with which the 50th sheet of the 100 sheets of thin paper (60 g/m$^2$ in basis weight) is conveyed.

In Step S102, the control portion 100 determines whether or not the fixing apparatus 10 needs to be changed in target temperature, based on the target fixing temperatures for the first and second sections of the mixed recording medium job, which can be estimated from the information such as basis weight and surface properties of the recording medium. If the control portion 100 determines that the changing is necessary, it proceeds to Step S103, in which it puts the fixing apparatus 10 in the second mode, in which the conditions under which the fixing apparatus 10 is controlled are changed, while the target temperatures are kept at the levels for the first section of the job. On the other hand, if the control portion 100 determines that the changing is not necessary, it proceeds to Step S108, in which it operates the image forming apparatus in the first mode, in which it keeps the temperature detected by the temperature sensor TH2 under a preset condition at the target temperature for the first section of the job.

In Step S103, the control portion 100 determines whether or not the target temperature for the second section of the mixed recording medium job is higher than the target temperature for the first section. Here, in the case of the thin paper, which is the recording medium for the first section, the target temperature is 150° C., whereas in the case of thick paper, which is the recording medium for the second section, the target temperature is 170° C. Thus, the control portion 100 determines that the fixing apparatus 10 has to increase the target temperature before the image forming apparatus starts the second section of the job. Then, the control portion 100 proceeds to Step S104.

In Step S104, the control portion 100 determines whether the remaining print count N1 for the first section satisfies: N1≤10. Here, if the second section of the job is received immediately after the conveyance of the 50th sheet for the first section, the remaining number of sheets to be conveyed in the first section of the job is 50 (=100−50). Therefore, the control portion 100 determines that N1 is greater than 10 (N1>10). Therefore, the control portion 100 proceeds to Step S105 while the 90th sheet for the first section, which makes N1 smaller than 10 (N1<10), is conveyed.

In Step S105, the control portion 100 determines whether or not the cumulative sheet conveyance count N2 for the first section is greater than 10 (N2>10). Here, after it receives the second section of the job, it does not proceed to Step S106 until the 90th sheet for the first section begins to be conveyed. Therefore, it determines that N2 is greater than 10 (N2>10). Thus, it proceeds to Step S106.

In Step S106, the control portion 100 controls the target temperature controlling portion 103 so that the target temperature for the heat roller 15 is increased. Here, it controls the target temperature controlling portion 103 so that the surface temperature of the heat roller 15, which is controlled based on the temperature detected by the thermistor TH1, from 170° C. to 190° C.

In Step S107, the control portion 100 turns on the cooling fan 30 and controls a cooling fan operation controlling portion 102 so that the temperature detected by the thermopile TH2 remains at the target temperature (150° C.) for the first section of the job.

In Step S108, the control portion 100 determines whether or not the conveyance of the sheets of recording medium for the first section of the mixed recording medium job has been completed. Here, after the conveyance of the 100th sheet of the recording medium for the first section, the control portion 100 determines that the conveyance of the sheets of recording medium for the first section is completed and proceeds to Step S109. In Step S109, the control portion 100 controls the cooling fan operation controlling portion 102 so that the cooling fan 30 is turned off.

In Step S110, the control portion 100 determines whether or not the temperature of the fixing belt 13 is at the preset target level for the second section of the job. In this case, as the temperature of the fixing belt 13 reaches the 170° C., the control portion 100 proceeds to Step S111.

In Step S111, the control portion 100 makes the image forming apparatus start forming an image on each of 100 sheets of thick paper for the second section of the job, which is 300 g/m$^2$ in basis weight.

(Control Sequence for Changing Recording Medium from Thick Paper to Thin Paper)

Next, referring to the flowchart in FIG. 7, the actual operational sequence for switching recording medium from thick paper to thin paper, is described with reference to a mixed recording medium job, in which recording medium is switched from 100 sheets of thick paper, which are 300 g/m$^2$ in basis weight, to 100 sheets of thin paper, which are 60 g/m$^2$ in basis weight.

In this case, it is assumed that the Steps S101 and S102 are the same as the counterparts in the operational sequence, described above, in which the target temperature for the second section of the job is higher than the one for the first section.

In Step S103, the control portion 100 determines whether or not the target temperature for the second section of the job is higher than that for the first section. Here, the target temperature for the thick paper to be used for the first section is 170° C., whereas that for the thin paper to be used for the second section of the job is 150° C. Thus, the control portion 100 determines that the target temperature has to be reduced for the second section of the job.

In Step S112, the control portion 100 determines whether or not the conveyance of the entire sheets of recording medium for the first section has been completed. Here, as the 100th sheet for the first section is conveyed, the control portion 100 determines that the conveyance has been completed and proceeds to Step S113.

In Step S113, the control portion 100 stops supplying the halogen heaters 17*a*, 17*b* and 17*c* with electrical power.

In Step S114, the control portion 100 turns on the cooling fan 30 and controls the cooling fan operation controlling portion 102 so that the temperature detected by the thermopile TH2 reduces to the target level (150° C.) for the second section of the job.

In Step S115, the control portion 100 determines whether or not the temperature of the fixing belt 13 has reduced to the preset target level (target temperature) for the second section of the job. Here, as the temperature of the fixing belt 13 reduces to 150° C., the control portion 100 proceeds to Step S116.

In Step S116, the control portion 100 makes the image forming apparatus start the second section of the job, which uses 100 sheets of thin paper, which are 60 g/m$^2$ in basis weight.

In Step S117, the control portion 100 determines whether or not the temperature of the heat roller 15 has reduced to the preset target level (target temperature) for the second section of the job. Here, as the surface temperature of the heat roller 15 reaches 170° C., the control portion 100 proceeds to Step S118.

In Step S118, the control portion 100 restarts supplying the halogen heaters 17*a*, 17*b* and 17*c* with electrical power. Then, it controls the amount by which electrical power is supplied to the halogen heaters 17*a*, 17*b* and 17*c*, with the use of the fixing target temperature controlling portion 103, so that the surface temperature of the fixing belt 13 remains at the preset level (150° C.) for the second section of the job.

In Step S119, the control portion 100 controls the cooling fan operation controlling portion 102 to turn off the cooling fan 30.

As described above, according to this embodiment, the fixing apparatus 10 is provided with the area in which the fixing belt is heated by the heat roller 15, area in which the fixing belt 13 is cooled by the cooling fan 30, and area in which the temperature of the fixing belt 13 is detected by the thermopile TH2, which are on the upstream side of the nip portion in terms of the moving direction of the fixing belt. The area in which the fixing belt 13 is heated by the heat roller 15 is the area in which the heat roller 15 is in contact with the fixing belt 13. The area in which the fixing belt 13 is cooled by the cooling fan 30 coincides with the projection of the cooling fan 30 upon the fixing belt 13, that is, the area in which the fixing belt 13 squarely faces the cooling fan 30. In a case when the cooling fan 30 is provided with a duct, the cooling area coincides with the projection of the opening of the duct upon the fixing belt 13, that is, the area in which the fixing belt 13 squarely faces the opening of the duct. Therefore, the length of time the image forming apparatus is kept on standby to switch recording medium can be minimized by controlling the temperature of the heat roller 15, and operation of the cooling fan 30. Therefore, this embodiment can improve an electrophotographic image forming apparatus in productivity.

Embodiment 2

This embodiment is characterized in that cooling fans are disposed on the upstream and downstream sides of the nip N in terms of the moving direction of the fixing belt 13. From the standpoint of toner image fixing in terms of toner offset, the target temperature (170° C.) for the thick paper for the mixed recording medium job in the first embodiment, is satisfactory. However, in a case when sheets of coated paper are used to obtain highly glossy images, each sheet of paper P and toner image T thereon are desired to be fixed (processed) at a higher temperature (180° C.) than the target temperature for the thick paper.

Here, it is assumed that the target fixing temperature for coated paper (which hereafter will be referred to as coated thick paper) which is no less than 120 g/m$^2$ in basis weight, is 180° C. In such a case, if the fixing apparatus 10 in the first embodiment is used for a fixed recording medium job which comprises the first and second sections which are different in recording medium (coated thick paper or thin paper), it is insufficient in cooling performance. Therefore, the image forming apparatus has to be kept on standby for a substantial length of time between the first and second sections of the job, in order to change the target temperature. More specifically, as the fixing belt 13 is cooled by the cooling fan 30 when the recording medium is switched from thin paper to thick paper, the heater is turned on to keep the temperature of the fixing belt 13 at the target level. However, if the fixing apparatus 10 is low in cooling performance, the amount by which heat is generated by the heater is small. Therefore, even after the cooling fan 30 is turned off, the temperature of the fixing belt 13 does not reaches the target level, until a substantial length of time elapses.

As a solution to this issue, it is possible to replace the cooling fan 30 in the first embodiment with a cooling fan which is higher is performance than the cooling fan 30. However, if the replacement cooling fan is excessively high in cooling performance, the following problems are likely to occur, because of the positioning of the cooling fans. That is, it is possible for the airflow generated by the cooling fan to detour into the areas where the airflow is not intended, and therefore, it is possible for the unfixed toner image T to be affected by unwanted airflow, and/or the surface of the fixing belt 13 fails to be uniformly cooled. That is, it is possible for the temperature of the fixing belt 13 to fail to reduce to the preset level.

In this embodiment, therefore, the fixing apparatus 10 is provided with additional cooling fans. Further, the cooling fans are disposed so that they can cool the surface of the fixing belt 13, between the exit end of the nip N and the area in which the fixing belt 13 is heated by the heat roller 15, in order to increase the fixing apparatus 10 in performance to cool the fixing belt 13 and heat roller 15. Therefore, it is possible to deal with even such a mixed recording medium job that the target temperature level for the thick paper is 180° C., and that for the thin paper is 150° C.

Since the additional cooling area is provided on the upstream side of the heating area, it is possible to more effectively cool the heat roller 15 than the fixing apparatus 10 in the first embodiment. Therefore, the image forming apparatus which employs the fixing apparatus 10 in this embodiment is shorter in the length of time that the image forming apparatus has to be kept on standby when switching between recording mediums. Further, the portion of the fixing belt 13, which was made nonuniform in temperature by the cooling, is eased in severity of the thermal nonuniformity, and also, more time is provided for making the aforementioned portion of the fixing belt 13 uniform in temperature. Therefore, this embodiment can be expected to contribute to improve the reliability of temperature control in a fixing apparatus.

Next, this embodiment is described. However, the image forming apparatus and fixing apparatus 10 in this embodiment are the same in structure and operation, except for the additional fans 40, as those in the preceding embodiment, unless specifically noted. Therefore, the structure and operation of the image forming apparatus and fixing apparatus in this embodiment, which are the same as the counterparts in the first embodiment, are not described.

(Image Heating Apparatus)

Figure 9:
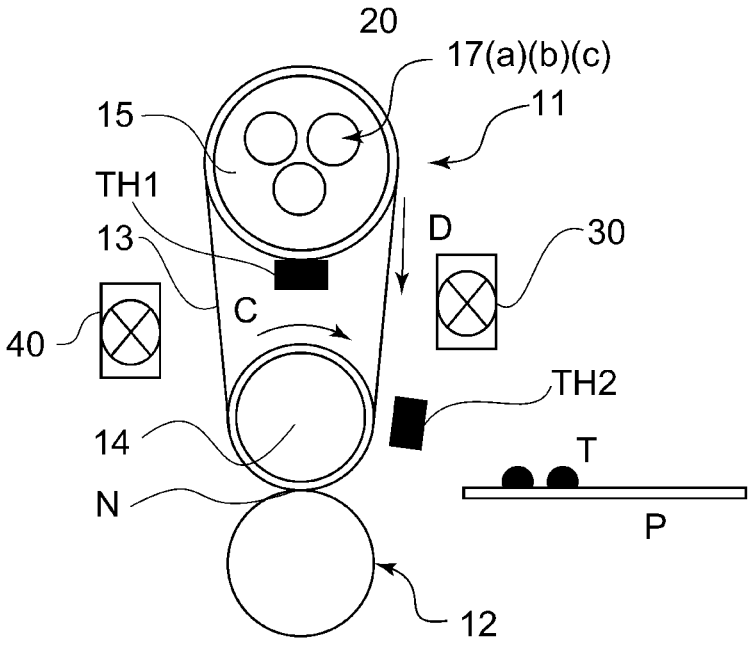
FIG. 9 is a schematic sectional view of the fixing apparatus in the second embodiment.

FIG. 9 is a schematic sectional view of the fixing apparatus 20, as an image forming apparatus, in this embodiment, at a plane perpendicular to the lengthwise direction. It shows the general structure of the apparatus 20. The fixing belt module 11 of the fixing apparatus 20 is provided with a cooling fan 40 as the second cooling fan, in addition to the cooling fan 30 as the first cooling fan. The cooling fan 40 is similar in structure to the cooling fan 30. It generates airflow to cool the surface of the fixing belt 13, in the area between the exit portion of the nip N in terms of the recording medium conveyance direction, and the heat roller 15.

(Control Sequence for Cooling for Mixed Recording Medium Job)

The control sequence for cooling the fixing belt 13 for a mixed recording medium job is the same as that in the first embodiment, except for the operation for controlling the cooling fans, which will be described next.

In a case of such a mixed recording medium job that sheets of thick paper are conveyed through the fixing apparatus 20 after the continuous conveyance of a substantial number of sheets of thin paper, the fixing belt 13 is changed in surface temperature from 150° C. to 180° C., between the first section of the job, which uses thin paper, and the second section which uses thick paper. Therefore, it is necessary for the heat roller 15 to be increased in temperature from 170° C. to 200° C. Therefore, while the sheets of thin paper are conveyed, and the heat roller 15 is increased in temperature to 200° C., and the cooling operation is started in order to keep the surface temperature of the fixing belt 13 at 150° C., like in the control sequence for the fixing apparatus 10 in the first embodiment.

Figure 10:
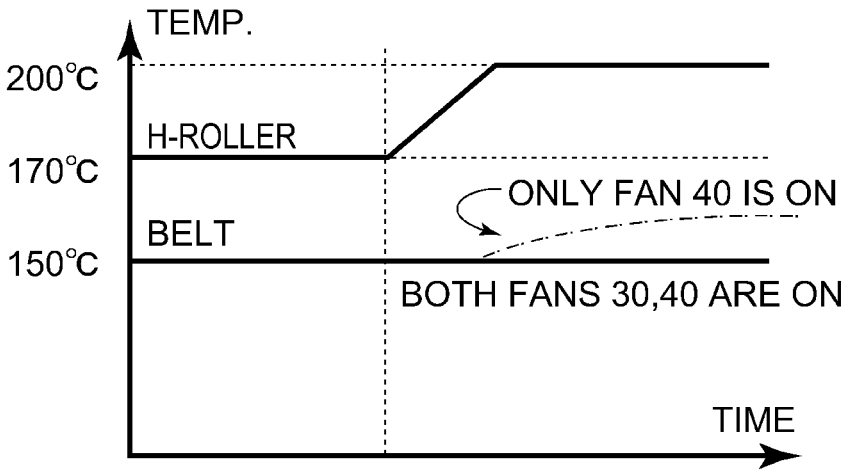

During this process, the cooling fan 40 is primarily used. That is, if possible, the surface temperature of the fixing belt 13 is kept at 150° C. with the use of only the cooling fan 40, and the temperature of the heat roller 15 is kept at 200° C. However, in a situation in which the cooling fan 40 is not strong enough to keep the surface temperature of the fixing belt 13 at 150° C. by itself as shown in FIG. 10 and, therefore, the fixing belt 13 increases in surface temperature, the cooling fan 30 is turned on to compensate for the lack of cooling performance to satisfy the following mathematical formulae:

$$F1 \leq F2$$

F1: cooling output (amount of airflow) of cooling fan 30

F2: cooling output (amount of airflow) of cooling fan 40.

Figure 8:
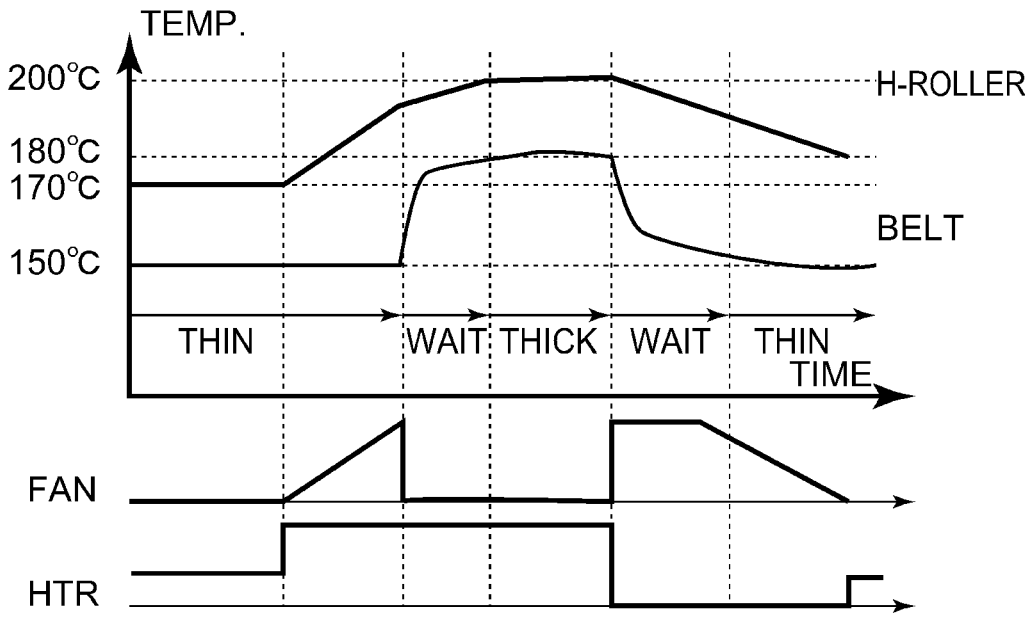
FIG. 8 is a graph which shows the relationship among the changes which occur to the temperature of the heat roller, temperature of the fixing belt, timing with which a cooling fan begin to be operated, and amount of heater output, when an image forming apparatus in the second embodiment of the present invention is used for a mixed recording medium job in which the first (preceding) section of the job and the second (following) section of the job are substantially different in the target temperature for fixing.

In a case of such a job that sheets of thin paper are conveyed after the continuous conveyance of a substantial number of sheets of coated thick paper, the fixing belt 13 has to be changed in surface temperature from 180° C. to 150° C. between the first and second sections of the job (FIG. 8). The cooling operation for this situation is the same as the one described above. That is, the fixing belt 13 is cooled in a manner to satisfy: $F1 \leq F2$. Then, the second section of the job is started.

One of the reasons why the cooling fan 40 is primarily used is that it takes a relatively long time for a given point of the fixing belt 13 to move from the downstream end of the area of contact between the heat roller 15 and fixing belt 13 (belt heating area) to the area in which the fixing belt 13 is cooled by the cooling fan 40, and this period of time is effective to reduce the fixing belt 13 in the nonuniformity in its surface temperature. The second reason is that the heat roller 15 is effectively cooled by cooling the fixing belt 13 on the upstream side of the nip N. The control sequence in this embodiment is the same as the one in the first embodiment, and therefore, is not described.

As described above, according to this embodiment, even in such a situation that the first and second sections of a mixed recording medium job, such as a job in which coated thick paper which is used to yield highly glossy images, and thin paper, are used in mixture, are substantially different in the target temperature for the fixing belt 13, the length of time the image forming apparatus (fixing apparatus 10) has to be kept on standby can be minimized. That is, this embodiment also can improve the productivity of an electrophotographic image forming apparatus.

Embodiment 3

Regarding the mixed recording medium jobs mentioned in the description of the first and second embodiments, if the first and second sections of the job use thin paper and thick paper, respectively (FIGS. 5 and 8), and the first section uses no more than nine sheets of recording medium, the control sequence for a mixed recording medium was not carried out. In comparison, in this embodiment, even if the number of sheets of recording medium used in the first section of the job is no more than nine, the control sequence for a mixed recording medium job is carried out to minimize the length of time an electrophotographic image forming apparatus has to be kept on standby. Next, this control sequence is described.

The structure of the image forming apparatus in this embodiment is the same as the structure of the image forming apparatus in the first embodiment, and therefore, is not illustrated nor described here. The fixing apparatus, as an image heating apparatus, in this embodiment is compatible with both the image forming apparatus and that in the second embodiment. In this embodiment, the present invention is applied to the fixing apparatus in the second embodiment, which is more effective than in a case when the present invention is applied to a fixing apparatus structured like the one in the first embodiment. By the way, structural components of the fixing apparatus 10 in this embodiment, which are the same as, or similar to, the counterparts in the second embodiment are not described about their structure.

(Control of Fixing Sequence for Mixed Recording Medium Job)

Here, control of the fixing sequence for such a mixed recording medium job that after five sheets of thick paper are conveyed through a fixing apparatus, five sheets of thin paper are conveyed, and then, five sheets of thick paper are conveyed, that is, such a job that a set of small number of sheets of thin paper and a set of small number of sheets of thick paper are alternately conveyed. More specifically, the first section of the fixed recording medium job is such a section that uses five sheets of thick paper which are 300 g/m$^2$ in basis weight, and the target temperature level for the fixing belt 13 is 170° C. The second section of the job is such a section that uses five sheets of thin paper which are 60 g/m$^2$ in basis weight, and the target temperature level for the fixing belt 13 is 150° C. The third section of the job is the same as the first section. The fixing operation is carried out for the mixed recording medium job in which the first to third sections are continuously carried out.

Figure 11:
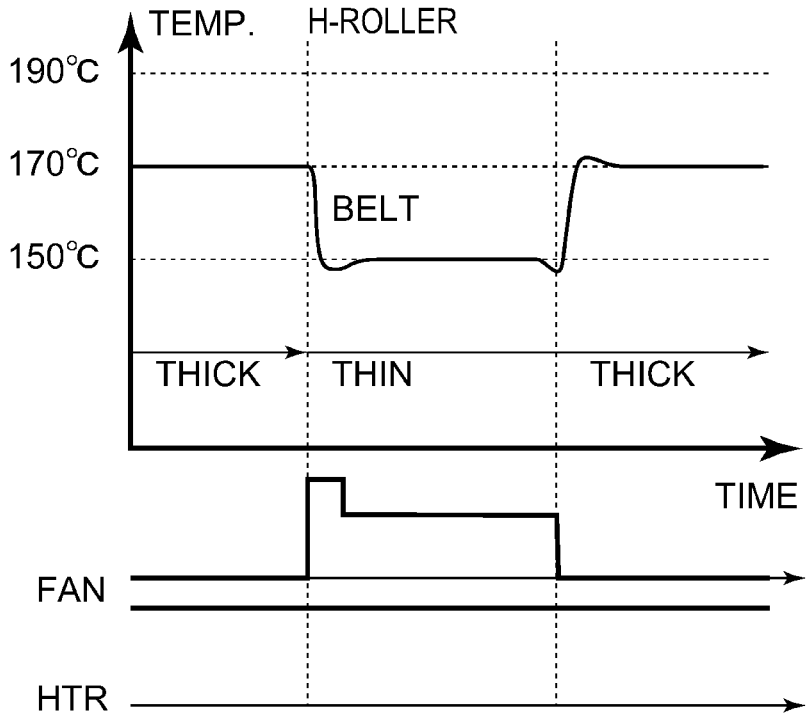
FIG. 11 is a graph which shows the relationship among the changes which occur to the temperature of the heat roller, temperature of the fixing belt, timing with which a cooling fan is turned on, and amount of heater output.

FIG. 11 shows the changes in the temperature of the heat roller 15 and the surface temperature of the fixing belt 13 which occur as the above described job is carried out. During the first section of the job, in which sheets of thick paper are conveyed, the cooling fan is not tuned on, and the temperature of the heat roller 15 is kept at approximately 190° C. to keep the temperature of the fixing belt 13 at the target level 170° C.

Next, during the period in which recording medium is switched from the thick paper for the first section of the job to the thin paper for the second section, the heat roller 15 is controlled so that its temperature (detected by temperature sensor TH1) remains at the same level (190° C.) as that for the first section. The cooling fans 30 and 40 are turned on so that the temperature (detected by thermopile TH2) of the fixing belt 13 remains at 150° C. for the thin paper. As soon as the temperature of the fixing belt 13 reduces to the target temperature for the thin paper, the control portion 100 makes the image forming apparatus to start the second section of the job.

Next, during the period in which the image forming apparatus moves from the second section of the job to the third section, which uses thick paper, the control portion 100 stops the cooling fans 30 and 40 at the same timing as the timing with which the second section of the job is completed. At this point in time, the temperature of the heat roller 15 will have reached the target temperature for thick paper. Therefore, the temperature of the fixing belt 13 quickly increases to 170° C., which is the target temperature level for the third section of the job. As soon as the temperature of the fixing belt 13 reaches the target temperature level for the third section, the control portion 100 makes the image forming apparatus start the third section of the job.

As described above, in a case when the image forming apparatus (fixing apparatus 10) in this embodiment is used for a mixed recording medium job which comprises two or more sections which are different in recording medium, and which is structured so that a set of preset number of sheets of thick paper and a set of preset number of sheets of thin paper are alternately conveyed through a fixing apparatus, the temperature of the heat roller 15 is kept at the target temperature level for thick paper. When the image forming apparatus carries out the section which uses thin paper, the cooling fans 30 and 40 are activated to reduce the temperature (detected by thermopile TH2) of the fixing belt 13 to the target temperature level for the thin paper and keeps it at the target temperature level for the thin paper. That is, in this embodiment, the control portion 100 keeps the temperature of the heat roller 15 at the highest one among those for two or more sections of the job and adjusts the temperature of the fixing belt 13 to the target temperature level for each section of the job with the use of cooling fans.

(Control Sequence)

Figure 12:
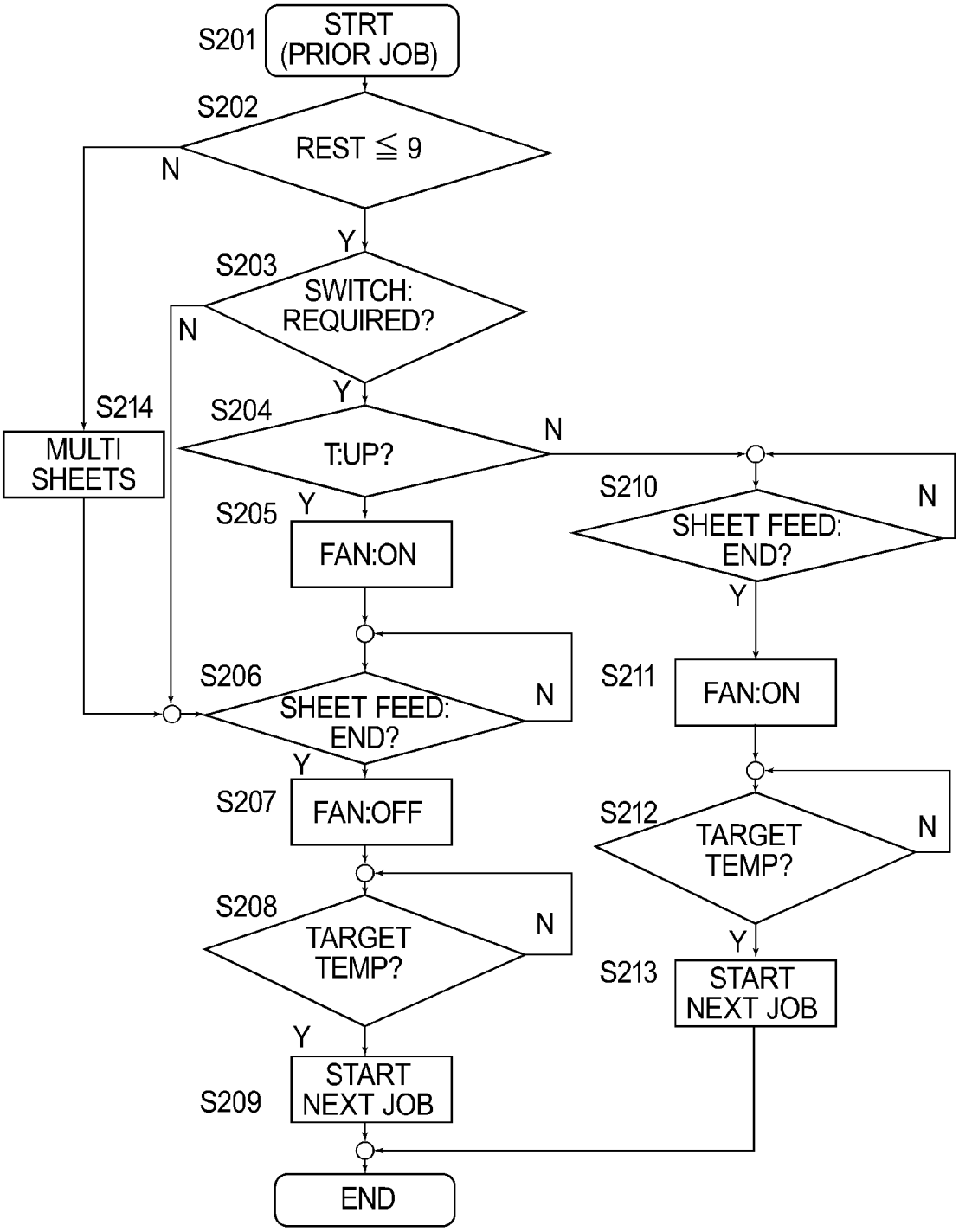
FIG. 12 is a flowchart for the operation of the image forming apparatus in the third embodiment of the present invention.

Next, referring to FIG. 12, the actual operational sequence, in this embodiment, for switching the image forming apparatus in recording medium, is described with reference to a mixed recording medium job in which recording medium is switched from a set of five sheets of thin paper which is 60 g/m$^2$ in basis weight to a set of five sheets of thick paper which is 300 g/m$^2$, and then, to a set of five sheets of thin paper which is 60 g/m$^2$ in basis weight.

To begin with, in Step S201, the control portion 100 receives such a mixed recording medium job that a set of sheets of thin paper and a set of sheets of thick paper are conveyed in the stated order, as the recording media for the first and second sections of the job. Then, the control portion 100 receives a command for switching recording medium while the control portion 100 is making the image forming apparatus carry out the first section (during first section). Whether or not recording medium is to be switched is determined by the control portion 100, based on the information about recording medium, image to be formed, and job type, which are stored in the job information holding means 101.

Here, it is assumed that the control portion 100 receives a command which is related to the second section of the job, which uses five sheets of thick paper which is 300 g/m$^2$ in basis weight, while the image forming apparatus is forming an image on the first of the five sheets of thin paper which is 60 g/m$^2$ in basis weight. As the first section of the job, which uses five sheets of thin paper is completed, the second section of the job, which uses five sheets of thick paper which is 300 g/m$^2$ in basis weight is started, and then, the control portion 100 receives the third section of the job which uses five sheets of thin paper which is 60 g/m$^2$ in basis weight.

By the way, even if a job which uses five sheets of thick paper which is 300 g/m$^2$ in basis weight and a job which uses five sheets of thin paper which is 60 g/m$^2$ in basis weight are received together, the jobs are processed as follows. That is, they are processed as if the second job was received while the image forming apparatus is forming an image on the first of the five sheets of thick paper which is 300 g/m$^2$ in basis weight.

In Step S202, the control portion 100 determines whether the sheet count of the first section of the job is no less than a preset value. In this embodiment if the sheet count for the first section of the job is no more than 10, the control portion 100 treats the section as a small sheet count job, whereas if the sheet count of the first section is no less than 10, the control portion 100 treats the first section as a large sheet count job. Then, the control portion 100 proceeds to Step S214, in which it controls the fixing apparatus in the same manner as it controlled the fixing apparatuses in the first and second embodiments. Since the sheet count for the first section of this job is five, the control portion 100 determines that the first section is equivalent to a small sheet count job and proceeds to Step S203.

In Step S203, the control portion 100 determines whether or not the fixing apparatus is to be changed in target temperature, based on the target fixing temperatures levels for the first and second sections of the job, which can be obtained based on the information, such as basis weight and surface properties, of the recording medium. If the control portion 100 determines that the fixing apparatus needs to be changed in target temperature, it proceeds to Step S204, in which it begin to operate the fixing apparatus in the second mode. In the second mode the control portion 100 changes the fixing apparatus in certain settings, while keeping the temperature of the fixing belt 13 at the target level for the first section of the job, during the first section of the job. On the other hand, if it determines that the fixing apparatus does not need to be changed in target temperature, it proceeds to Step S206, in which it operates the fixing apparatus in the first mode, which is for keeping the temperature detected by the temperature sensor TH2 under preset conditions, at the target level for the first section of the job.

In Step S204, the control portion 100 determines whether the target temperature for the second section of the job is higher than that for the first section. Here, the target temperature for the thick paper for the second section is 170° C. and that for the thin paper for the first job is 150° C. Therefore, the control portion 100 determines that the fixing apparatus 10 is to be increased in target temperature. Then, it begins to control the amount by which electrical power is supplied to the halogen heaters 17*a*, 17*b* and 17*c*, with the use of the fixing temperature controlling portion 103, so that the temperature of the heat roller 15 reaches, and remains at, 190° C. which is the target temperature for the thick paper. Then, it proceeds to Step S205.

In Step S205, the control portion 100 turns on the cooling fans 30 and 40 and controls the cooling fan operation controlling portion 102 so that the temperature detected by the thermopile TH2 remains at the target temperature (150° C.) for the first section of the job.

Then, the control portion 100 determines, in Step S206, whether or not the conveyance of the entirety of the sheets of recording medium for the first section of the job has been completed. Here, as the fifth sheet is conveyed for the first section, the control portion 100 determines that the first section of the job has been completed and proceeds to Step S207.

In Step S207, the control portion 100 controls the cooling fan operation controlling portion 102 so that the cooling fans 30 and 40 are turned off.

Then, the control portion 100 determines, in Step S208, whether or not the temperature of the fixing belt 13 has reached the target temperature for the second section of the job. Here, as the temperature of the fixing belt 13 reaches 170° C., or the target temperature, the control portion 100 proceeds to Step S209.

In Step S209, the control portion 100 begins to process five sheets of thick paper for the second section of the job, which are 300 g/m$^2$ in basis weight.

Then, the control portion 100 changes the fixing apparatus control from the one for the second section of the job to the one for the first section and moves to the second section of the mixed recording medium. In Step S202, the sheet count for the third section of the job is also five. Therefore, the control portion 100 determines that the third section is also a small sheet count section and proceeds to Step S203. In Step S203, the target temperature for the fixing apparatus has to be changed from the one for the thick paper to the one for the thin paper. Therefore, the control portion 100 proceeds to Step S204. In Step S204, the target temperature has to be reduced from the one for thick paper to the one for thin paper. Therefore, the control portion 100 proceeds to S210.

If it is determined, in Step S204, that the fixing apparatus does not need to be increased in target temperature, the control portion 100 determines, in Step 210, whether or not the sheet conveyance for the preceding section of the job has been completed. Here, as five sheets of recording medium are conveyed, the control portion 100 determines that the sheet conveyance for the preceding section of the job has been completed. Then, it proceeds to Step S211.

In Step S211, the control portion 100 turns on the cooling fans 30 and 40 and controls the cooling fan operation controlling portion 102 so that the temperature detected by the thermopile TH2 falls to the target temperature (150° C.) for the following section of the job.

In Step S212, the control portion 100 determines whether or not the temperature of the fixing belt 13 has reached the target temperature for following (third) section of the job. Here, as the temperature of the fixing belt 13 reaches 150° C., the control portion 100 proceeds to Step S213.

In Step S213, the control portion 100 begins to process the five sheets of thin paper for the following (third) section of the job, which are 60 g/m$^2$ in basis weight.

As described above, this embodiment can reduce the length of time the image forming apparatus (fixing apparatus 10) has to be kept on standby, even if the sheet count N of the preceding section of the mixed recording medium job is no more than 10 ($N \leq 10$). That is, this embodiment also reduce an electrophotographic image forming apparatus (fixing apparatus therefor) in reduces the length of time an electrophotographic image forming apparatus (fixing apparatus therefor) has to be kept on standby when the apparatus is changed in recording medium, and therefore, can improve the apparatus in productivity. By the way, the structural arrangement for the fixing apparatus in this embodiment is compatible with the apparatuses in the first and second embodiments. That is, according to this embodiment, it is possible to improve a fixing apparatus for an electrophotographic image forming apparatus in productivity, by reducing the length of time it has to be kept on standby when the apparatus is used for a mixed recording media job which comprises two or more sections which are different in recording medium.

(Modified Versions)

In the foregoing, a few of preferred embodiments of the present invention were described. However, these embodiments are not intended to limit the present invention in scope. That is, the present invention is also applicable to various modified version of the fixing apparatuses in the preferred embodiments, within its scope.

(Modified Version 1)

In the embodiments described above, the fixing apparatuses are structured so that the fixing belt 13 is suspended and tensioned by the fixing roller 14 and heat roller 15. However, the present invention is applicable to a fixing apparatus having two or more heat rollers. That is, referring to FIG. 13, the present invention is also applicable to a fixing apparatus structured so that the fixing belt 13 is suspended and tensioned by a pair of heat rollers 15A and 15B. Further, the present invention is also applicable to a fixing apparatus which employs a pressing member 14B as a nip forming member for forming the nip N, and which is structured so that the pressing member 14B forms the nip N in coordination with the pressure roller 12, by providing a surface on which the fixing belt 13 slides by its inward surface.

Figure 13:
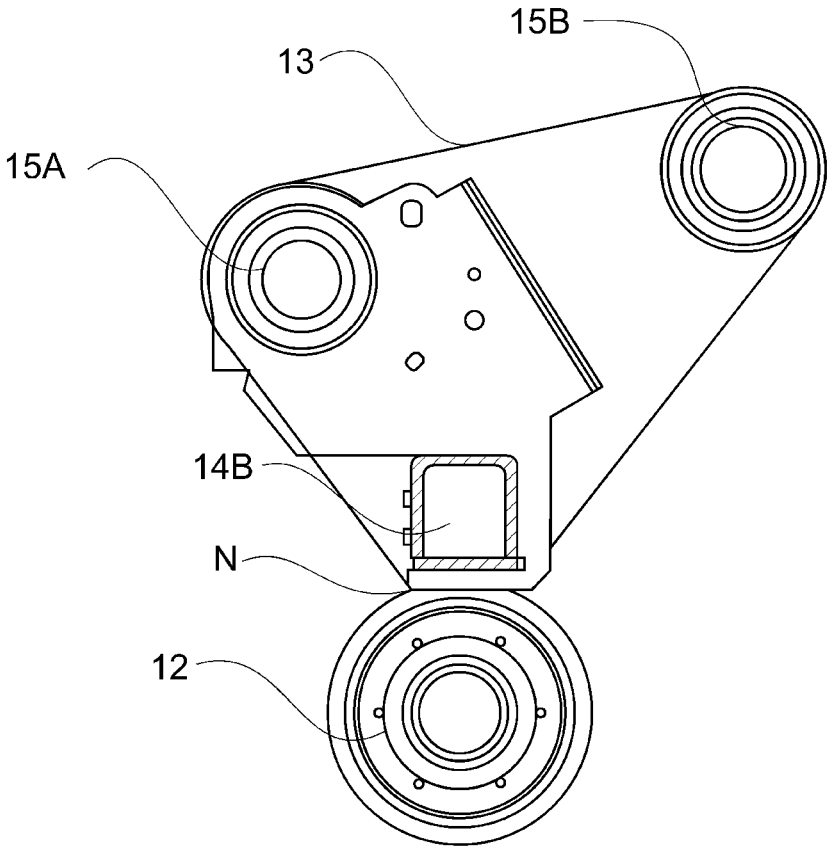
FIG. 13 is a schematic sectional view of one of the modified versions of the fixing apparatuses in the preceding embodiments.

Referring to FIG. 13, the fixing belt 13 is heated by two or more heating means which includes the heat roller 15B. As the portion of the endless belt, which is between the downstream and upstream ends of the nip N, in terms of the rotational direction of the belt, the heat roller 15B is positioned as follows. That is, it is positioned most downstream in terms of the rotational direction of the belt, among the two or more belt heating members.

(Modified Version 2)

Regarding the positioning of the cooling fan 30, the fixing apparatus may be structured as follows. That is, the fixing apparatus may be provided with a duct through which the airflow generated by the cooling fan 30 is sent to the endless belt, and the duct is positioned so that its exit opening faces the outward surface of the endless belt. In this case, the cooling area is where the exit opening of the duct faces the endless belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device for fixing a toner image on a recording material, the fixing device comprising:

a rotatable fixing belt;

a pressing roller cooperating with said fixing belt to form a nip configured to nip and to feed the recording material;

a pad contacting an inner surface of said fixing belt, said fixing belt being sandwiched between said pressing roller and said pad in the nip;

a heating roller including a heater, said heating roller stretching said fixing belt;

a cooling portion including a fan configured to blow air on said fixing belt thus cooling said fixing belt, said cooling portion being opposed to a surface of said belt at a position downstream of said heating roller and upstream of said pad in a rotational movement direction of said fixing belt;

a belt temperature detecting member configured to detect a temperature of the surface of said fixing belt at a position downstream of said cooling portion and upstream of the nip in the rotational movement direction of said fixing belt; and a controller configured to control electrical power supply to said heater and to control operation of said fan on the basis of an output of said belt temperature detecting member.

2. The fixing device according to claim 1, further comprising a heating roller temperature detecting member contacting said heating roller to detect a temperature of said heating roller, wherein said controller controls the electrical power supply to said heater on the basis of an output of said belt temperature detecting member and an output of said heating roller temperature detecting member.

3. The fixing device according to claim 2, wherein, when a first recording material having a first basis weight is to be heated, said controller controls the electrical power supplied to said heater such that a temperature detected by said belt temperature detecting member is a first target temperature, and wherein, when a second recording material having a second basis weight is to be heated, said controller controls the electrical power supplied to said heater and operation of said fan such that the temperature detected by said belt temperature detecting member is a second target temperature, the second basis weight being greater than the first basis weight and the second target temperature being higher than the first target temperature.

4. The fixing device according to claim 3, wherein, when the first recording material is to be heated, said controller controls the electrical power supplied to said heater such that the temperature detected by said heating roller temperature detecting member is a third target temperature, wherein, when the second recording material is to be heated, said controller controls the electrical power supplied to said heater such that the temperature detected by said heating roller temperature detecting member is a fourth target temperature, the fourth target temperature being higher than the third target temperature, and wherein, when a first image formation job is continuously followed by a second image formation job, said controller (i) controls the operation of said fan while controlling the electrical power supplied during the execution of the first image formation job such that the temperature detected by the heating roller temperature detecting member is the fourth target temperature and such that the temperature detected by said belt temperature detecting member is the first target temperature and (ii) starts the execution of the second image formation job, the first image formation job being an image formation job in which a plurality of first recording materials are continuously fed and the second image formation job being an image formation job in which the second recording material is fed.

5. The fixing device according to claim 3, further comprising, in addition to said fan, which is a first fan, a second fan configured to cool said belt at a position downstream of said pad and upstream of said heating roller with respect to the rotational movement direction, wherein, when a third image formation job is continuously followed by a fourth image formation job, said controller operates said first fan and said second fan to cool said belt before the start of the fourth image formation job, the third image formation job being an image formation job in which a plurality of second recording materials are continuously fed and the fourth image formation job being an image formation job in which the first recording material is fed.

6. The fixing device according to claim 1, wherein said cooling portion further includes a duct having an opening opposed to an outer peripheral surface of said fixing belt at a position downstream of said heating roller and upstream of said pad in the rotational movement direction of said fixing belt, wherein fan said duct is configured to feed the air blown by said fan to said fixing belt.

7. The fixing device according to claim 1, further comprising a stretching roller configured to stretch said fixing belt.

8. The fixing device according to claim 1, wherein said heating roller is disposed immediately downstream of said pad in the rotational movement direction.

* * * * *